United States Patent [19]

Gebert et al.

[11] Patent Number: 5,008,666

[45] Date of Patent: Apr. 16, 1991

[54] TRAFFIC MEASUREMENT EQUIPMENT

[76] Inventors: Franz J. Gebert; Johannes P. Theron; Ralf D. H. Gebert; Rudiger H. Gebert, all of P.O. Box 14183, Lyttleton, Transvaal, South Africa

[21] Appl. No.: 420,762

[22] Filed: Oct. 12, 1989

Related U.S. Application Data

[63] Continuation-in-part of Ser. No. 176,257, Mar. 31, 1988, abandoned.

[30] Foreign Application Priority Data

Apr. 2, 1987 [ZA] South Africa ..... 87/2386

[51] Int. Cl.[5] ..... G08G 1/02

[52] U.S. Cl. ..... 340/936; 340/939; 340/933

[58] Field of Search ..... 340/933, 934, 936, 939; 73/146, DIG. 4; 364/436, 438; 377/9

[56] References Cited

U.S. PATENT DOCUMENTS

| | | | |
|---|---|---|---|
| 3,398,397 | 8/1968 | O'Connell | 73/146 |
| 4,374,299 | 2/1983 | Kincaid | 340/933 X |
| 4,383,239 | 5/1983 | Robert | 377/9 X |
| 4,712,423 | 12/1987 | Siffert et al. | 73/146 |
| 4,789,941 | 12/1988 | Nunberg | 340/933 X |

FOREIGN PATENT DOCUMENTS

| | | | |
|---|---|---|---|
| 2084774 | 4/1982 | United Kingdom | 340/933 |

*Primary Examiner*—Joseph A. Orsino
*Assistant Examiner*—Brian R. Tumm
*Attorney, Agent, or Firm*—William R. Evans

[57] ABSTRACT

Traffic measurement equipment has a pair of coaxial cables having barium titanate piezo-electric responsive crystals embedded in the polymer together with a vehicle presence detector to indicate all measurements required of traffic including vehicle count, vehicle length, vehicle time of arrival, vehicle speed in any required measure, number of axles per vehicle, axle distance per vehicle, vehicle gap, headway and axle weights.

19 Claims, 4 Drawing Sheets

TRAFFIC MEASUREMENT EQUIPMENT

This is a continuation in part of copending but now abandoned application Ser. No. 07/176,257 filed Mar. 31, 1988.

BACKGROUND OF THE INVENTION (1) Field of the Invention

This invention concerns improvements in and relating to traffic data acquisition which includes weight reporting and data which may be processed for law enforcement and for road engineering.

(2) Prior Art

Sophisticated equipment has been developed for traffic data processing and law enforcement. This equipment is based on coaxial cables exhibiting piezo-electric and/or tribo-electric effects, loop detectors and axle weight pads. Weight measurement of vehicles at speed has in particular been difficult and the state of the art weight measurement pad developed from the technology described in South African patents 68/4975 and 69/1840 is cumbersome and costly. The weight pad has a further problem in that it does not report footprint area of the vehicle wheel so that the pressure on the road (which is the criterion of interest to road design engineers) cannot be directly reported nor reliably computed. One of the present inventors has been aware from an early stage that the comparatively cost effective coaxial cable developed from technology described in South African patent No. 66/0934 does exhibit a weight sensitive response. However, these PVC based coaxial cables could never be used for weight measurement because of problems from the cable itself and from limited signal processing capabilities or means. The cable of the time exhibited problems that still exist today (in any dynamic weight measuring system) but the extent and influence of these errors were enhanced by the then poor production processes, quality controls and technologies. These problems could be described as scatter, correlation, temperature dependence, speed dependence, cross-wise dependence and general sensitivity (poor signal to noise ratio). Scatter described the phenomenon whereby the same axle weight driven at the same speed in the same cross-wise position and at the same temperature in successive readings gives different peak or peak-to-peak outputs from the standard PVC based coaxial cables. It has not been feasible to identify the origin of this scatter. Traffic measurement equipment is exposed to severe temperature extremes, for example, from sub-zero temperatures to 80° C. and the electrical signal received from such cables is heavily temperature dependant. Even software and/or hardware based temperature compensation technique and calibration of each particular cable has not been able to provide a satisfactory solution of this problem. The standard PVC coaxial cable also exhibited speed dependance, the peak value of the pulse rising with rising speed but again with a significant statistical component or scatter so that this problem too could not be satisfactorily solved by means of a calibration based approach. Finally the state of the art PVC coaxial cable frequency exhibited cross-wise dependence, that is, the precise position along the length of such a cable stretched across the road at which the vehicle wheel passed over it should be controlled, which in practice was impossible.

This great variation in the general sensitivity of the cable made signal/noise ratio adjusting very difficult. The signals produced from light vehicles at low speeds normally fell in the noise regions making detection of passing axles very difficult at low speeds. Signal processing means involved standard transistor technology coupled with TTL integrated circuits of the time. Although certain acceptable levels of correlation were found between the voltage peak parameter and dynamic axle weight, this varied from detector to detector and site to site. This brought into question production repeatability and calibration requirements. The calibration value was also found to be dependent on temperature, installation method and life span since the cable's uniformity changed due to its mechanical stress characteristics along its length. This added to the inherent cross-wise dependability of the system. More tests involving signal integration and differentiation, each involving different installation methods, were unsuccessful in bettering the axle weight to voltage signal correlation values.

U.S. Pat. No. 4,712,423 to Siffert et al. discloses the use of piezo electric cables to determine the weight and speed of vehicles which cross a cable. Siffert et al. shows an analogue processing circuit and carries out a linear integration of the signal from the cable which gives a result which is influenced by the polarity reverses of the signal. This sums the positive and negative areas under the curve representing the signal and gives a net total.

All signal processing is required in real time and this limited the use of early micro-computer technologies, apart from their general power requirements and availability, the only high frequency (high speed processing) devices. Early micro-computer trials were unsuccessful due to the low reliability under exposed conditions and high development costs.

SUMMARY OF THE INVENTION

The problems discussed above are solved in accordance with this invention in a traffic data acquisition method comprising laying an electrically conductive cable with at least two conductors separated by a material which has electrical properties selected from one or more of piezo-electric, tribo-electric, magneto- and/or electrostrictive effects, connecting the conductors to an electronic processor comprising an amplifier, digitiser and micro-processor, detecting signals induced in the cable by passage of vehicle wheel(s) over it, and processing the signals, the improvements in that the processing of the signals comprises computing a total integrated spectral power of the signals, establishing an empirical relationship between speed and weight of other vehicle wheel(s) passing over the cable and total spectral power for the cable, inputting the computed total spectral power and the one of the speed or weight of the vehicle wheel(s) thereof into the empirical relationship and deriving the other one of the weight or speed of the latter vehicle wheel(s) from the empirical relationship. Manufacturing the cable to exact specifications and good quality control ensures a uniform, repeatable cable with a minimum dependency on temperature, cross-wise sensitivity and a good general signal to noise ratio.

The two conductors are connected via electronics which include an amplifier, digitiser and microprocessor or computer. The signals originating from the cable are then processed, using digital signal processing techniques, which, due to the speed and power of the microcomputer enables virtual real time complex evaluation of each signal according to any number of parameters including peak value, integrated value, derivation value, positive values, negative values, pulse length value, etc. The invention in particular describes the use of the integrated or total spectral power parameter in determining the correlation to axle weight. It further includes the use of multiple parameters to optimize output resolution for each output requirement, be it speed, weight, count, contact length and pressure. An empirical relationship is then established between speed, weight and the measured parameters most suited for speed and/or weight and/or tire characteristics, e.g. contact length, width, pressure. This relationship is then calibrated to enable the system to derive one or more of the required outputs, e.g. speed, weight, axle count and tire characteristics.

In this way the dynamic weight on rood surface is continuously measured through direct contact and subsequently processed and recorded if desired. This processed information can also be used for traffic pattern analysis, pavement design and rehabilitation, economic analysis, truck design, vehicle classification and can include screening and counting. The processed output of the system can therefore be used as valuable data input for different analyses especially as this data would be cost effective and available on continuous basis if required. The integrated or total spectral power is derived by programming a real time micro-computer according to an algorithm which implements the following derivation:

Assume a set of voltage measurements V(t) where $V(t)=\{v(1), v(2), v(3) \ldots V(n-1)\}$.

The Fourier transform of $V(t) \mid V(\nu)$ $$V(\nu) = \frac{1}{n} \sum_{t=0}^{n-1} V(t)\, e^{2\pi j(\nu/n)t}$$

$V(\nu)$ is a complex valued function:

$$V(\nu)=V'(\nu)+jV''(\nu)$$

The power spectrum of V(t) is defined a:

$$PS=(V(\nu)\cdot V(\nu)^*)$$

where $V(\nu)^*$ is the complex conjugate of $V(\nu)$ what we have called the integrated (total) spectral power (isp) is defined as $$ISP = \int_0^{\nu} (V(\nu)\cdot V^*(\nu)\, d\nu$$

which for discrete samples would be solved numerically. The inventors solved the Isp integral by lowest order integration, the trapezium rule. The time varying pulse is converted firstly to the frequency domain by taking the Fourier Transformer (or any other method) and then integrating the result with respect to frequency. A speed correction is implemented by software (not a linear response). V(t) has Fourier Transform V(f) i.e.

$$V(f) = \frac{1}{n} \sum_{t=0}^{n-1} v(t)\, e^{2\pi(f/n)t}$$

We then take the result (spectrum) and integrate it with respect to frequency which gives us the total spectral power.

$$\begin{aligned} I.S.P &= \int_0^f (V(f)\, V(f)^*)\, df \\ &= \int_0^f (V(F)^2)\, df \end{aligned}$$

with $V(f)^*$ = complex conjugate

A speed correction factor is implemented by software. This is thus related to the Parseval energy theorum:

$$\int_{-\infty}^{\infty} |x(t)|^2 \cdot dt = \int_{-\infty}^{\infty} |x(f)|^2\, df$$

Thus the squared signal may be integrated either in the frequency or time domain, in accordance with the total integrated spectral power approach of this invention.

The present invention may be implemented in the context of the invention described in South African patent No. 81/6666.

A preferred cable is the case where the piezo-electric effect predominates over any others, and this can be achieved by the employment of a formulation comprising or consisting of a pulverised piezo-electric crystalline material provided as a filler in a synthetic polymer which itself may also exhibit piezo-electric properties. Preferably a two-core coaxial cable the type where the insulation between the inner core and the concentric outer core exhibits the preferred electrical effect is employed, because the outer conductor may then serve as a shield against electrical noise from extraneous sources.

In accordance with the invention the elastic matrix around the cable is at least partially enclosed in protective structure. In one embodiment partial enclosure is provided by a groove out into a road surface, for example, the elastic matrix filling the groove and embedding the cable. Although quick and inexpensive, this also has the advantage of a semi-permanent or permanent installation.

In an alternative embodiment the elastic matrix is entirely enclosed in a flexible sheath or tube which is given an abrasion resistance and toughness to adapt it to stand up to exposure to traffic when laid on top of the road surface. Preferably a metal base plate or other flat base plate is provided under the sheath to give crosswise independance or insensitivity.

In a further embodiment the cable is arrayed in a parallel, zig-zag, sinuous or other array to provide an extended surface area of the elastic matrix in which the cable is embedded to form a pad. The cable may be electrically connected in a continuous series connection in a sinuous or zig-zag array or it may be connected in a multiple parallel connection in a comb-like array.

The cable may be of circular cross sectional shape but may also conveniently be of D-cross section, square or rectangular cross section, for example, to better suit it to a particular application.

It is preferred that the elastic matrix is temperature insensitive in particular in regard to its coefficient of elasticity or at least that the temperature dependence is consistently repeatable and can so be compensated for by means of a hard wired, firmware or software compensation function and preferably the temperature dependence is minimal.

In accordance with one embodiment of the invention two separate twin cables are employed at a standard distance apart in a parallel cross-wise array in a road to be utilised for speed measurements in addition to the same cables providing weight pressure measurements. In such a case the weight pressure measurements computed from the two cables can be averaged so as to minimise discrepancies arising from vehicle suspension dynamics or other statistical variables. Preferably further such a two cable array is complimented by a means of a presence detector to provide traffic data acquisition capabilities such as are described, for example, in S.A. Pat 81/6666. With the present invention to these capabilities can be added pressure measurement and weight inference can be made by use of the apparatus in accordance with this invention. These facilities include, for example, vehicle count, vehicle length, vehicle time of arrival, vehicle speed, number of axles per vehicle, axle distance(s) per vehicle, vehicle gap, headway contact length/width and axle pressure all measured by means of the two cables and the presence detector.

Vehicle speed may in accordance with this invention alternatively be detected by suitable parameters of electrical response of a single cable, as is more fully described below.

BRIEF DESCRIPTION OF THE DRAWINGS

The invention will be more fully described by way of examples with reference to the accompanying drawings in which.

DESCRIPTION OF THE PREFERRED EMBODIMENTS

Figure 1:
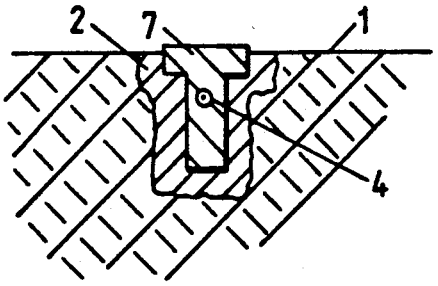
FIG. 1 is a transverse cross-sectional elevation of a preferred embodiment of the invention in a rod.
Figure 2A:
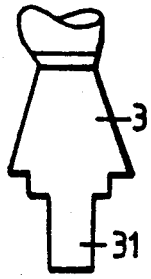
FIG. 2*a* is a schematic drawing of a tool used in preparing a groove for embedding a cable shown in FIG. 2*b*, as shown in FIG. 1.
Figure 2C:
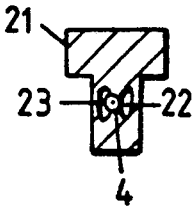
FIG. 2*c* is a transverse cross-sectional elevation of an alternative embodiment.
Figure 2D:
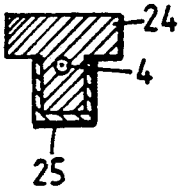
FIG. 2*d* is a transverse cross-sectional elevation of another alternative embodiment.
Figure 4A:
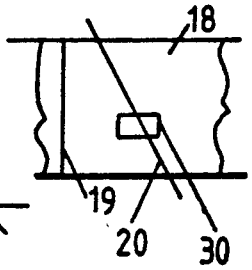
FIG. 4*a* is a plan view of a cable layout for estimating footprint area.
Figure 4:
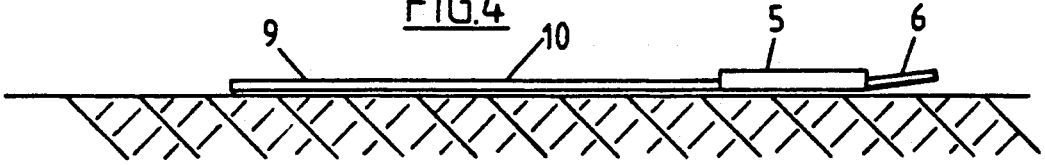
FIG. 4 is a side view of the embodiments shown in FIGS. 1 and 3.

As shown in FIG. 1, a road surface 1 is selected preferably where the road is fairly smooth to minimise dynamic effects from vehicle suspension. A diamond cutting disk is then used to cut a groove 2 cross-wise across the width of the road which is to be monitored. Then a lining of an epoxy or bitumen composition is made by pouring this composition into the groove and then drawing a forming tool 3 as is shown in FIG. 2*a* through the groove. The tongue 3,1 of the tool 3 then defines a groove of precise width and depth which is important in order to achieve cross-wise independance in the read out from the equipment. As soon as the epoxy bitumen composition has set sufficiently the piezo-electric coaxial embedded cable 4 is laid in the groove with one end suitably electrically connected to an impedance convertor 5 as shown in FIG. 4 from which signal cable 6 can be led to electronic processing equipment.

Figure 1A:
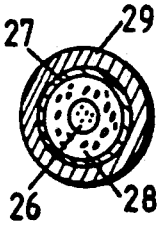
FIG. 1*a* is an enlarged transverse cross-sectional elevation of a cable portion of FIG. 1.

FIG. 1*a* shows a preferred piezo-electric cable (4 in FIGS. 1, 2*b*, 2*c*, 2*d* and 3) comprising a central conductor 26 shielded by a coaxial conductor 27 with a PVC (polyvinyl chloride) extrusion separating the conductors and having barium titanate crystals 28 in the PVC, an outer protective coating 29 being extruded around the outer conductor 27.

Figure 2B:
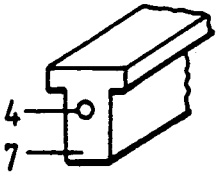

FIG. 2*b* shows the cable 4 which is embedded in a matrix 7 which is formed by extrusion, feeding the cable through the extrusion die. A filler or matrix 7 around the cable 4 can be a silicon rubber which has the great advantage of being temperature stable. However, other elastic settable polymers such as polyurethane can be used, selected to optimise the required properties. Apart from elastic modulus stability with temperature variation it is desirable that the material is abrasion resistant. Where the desired properties cannot all be obtained in the single material combinations of materials could be used. For example, an abrasive resistant skin could be applied over the top of the silicon rubber which has a rather poor abrasion resistance.

A suitable matrix material is selected with a Poisson's ratio as close to 0.5 as possible as this will reduce the effect of environmental factors changing the sensitivity of the cable due to changing material properties.

The matrix 7 can be provided advantageously in the material DOW CORNING J RTV which is a two part silicone, rubber flexible mould making material having the following typical properties:

| Typical properties | | |
|---|---|---|
| As Supplied | Test method | |
| As Cured | | |
| Viscosity at 25° C. (77° F.) after addition of curing agent | | 100 |
| Snap time hours | | 3 |
| Base to curing agent ratio | | 10,1 |
| 24 hours at 25° C. (77° F.) | | |
| Durometer Hardness, Shore A | ASTM D 2240 | 60 |
| Tensile Strength, MPa | ASTM D 412 | 5.5 |
| Tensile strength at 150% Elongation, MPa | ASTM D 412 | 4,9 |

-continued

| Typical properties | | |
|---|---|---|
| Elongation % | ASTM D 412 | 250 |
| Tear strength, kN/m | ASTM D 824 | 14,7 |
| Specific gravity at 25° C. (77° F.) | | 1,29 |
| Linear Shrink, % | | 0,1 |

The values given in this table are not intended for use in preparing specifications. Please contact Dow Corning Europe, Brussels, Belgium before writing specification on these products.

An alternative method of reducing the effect of material properties on the sensor sensitivity is to reduce the width of the sensor. The horizontal stress on the cable would diminish in addition to this, the accoustic coupling between the matrix and horizontal edges of the cable could be reduced by introducing air gaps in the matrix level with the side of the sensor. Any horizontal stress would be decoupled from the cable.

Pigments (carbon black) can be added to the matrix material in small quantities 0.5% Vol to improve the stability of the material to ultraviolet radiation.

The material should be selected for environment stability, the following parameters are of importance:

1. Low change in material properties with temperature.
2. Low water absorbtion and/or resistance to denaturing by water.
3. Resistance to degradation by U-V light.
4. Mechanical toughness, high tear strength and wear resistance.
5. The material should adhere well to the piezo-electric cable—possibly a primer should be used to improve bonding.
6. Moderately high stiffness.

Point 6 has been included in the list for two reasons. Firstly a material with a high stiffness would reduce the magnitude of the horizontal stress of the cable and secondly the natural resonance of the sensor assembly would be higher, improving the resolution at high vehicle speeds. At present a frequency of approximately 600–700 hZ is excited at high vehicle speeds.

It is desirable that the cross sectional size of the cable be as small as possible e.g. 2.5 mm diameter to minimise the mass per lineal dimension of the cable and hence maximise the sensitivity of response of the cable's piezo-electric characteristics to a pressure applied especially in the form of a shock wave as may arise in high speed measurements. This cable could be of square cross section or other suitable cross section such as a D cross section.

The piezo-electric properties are preferably obtained by the impregnation of the polymer which lies between the conductors with piezo-electric crystals in powder form such as barium titanate.

Values quoted in the manufacturer's specifications on the cable indicate that the sensitivity of the cable is approximately −205 dB re 1 V/uPa which corresponds to $5.62\times10^{-11}$ volts generated by the cable in response to a uniform pressure on the cable of 1 uPa.

Figure 12:
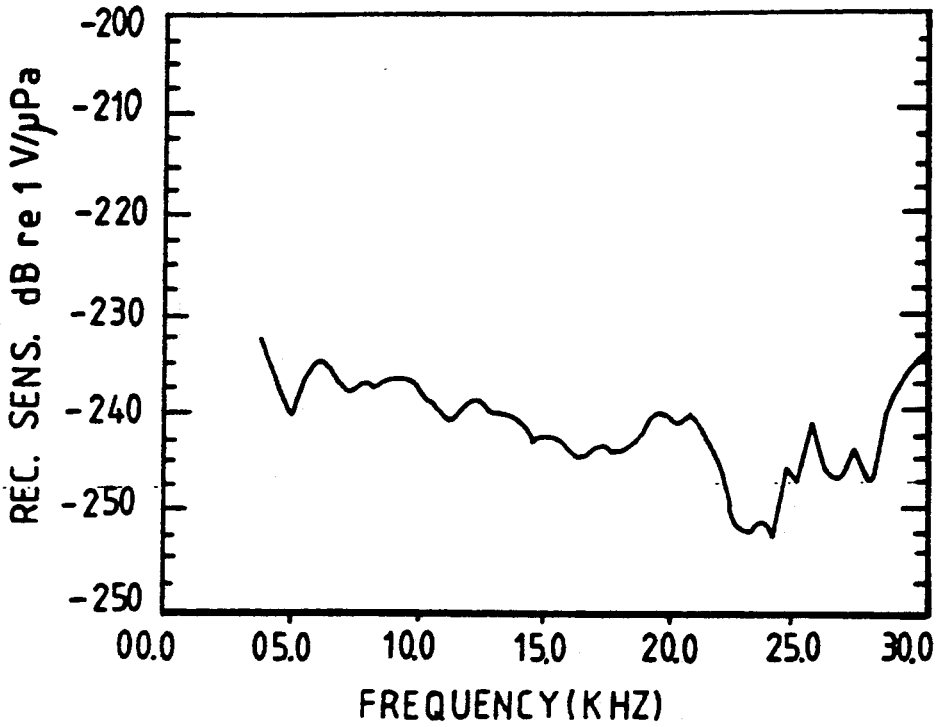
FIG. 12 is a graph of pressure sensitivity vs. frequency.

Measurement of the sensitivity of the cable in the elastomer matrix at the NIMR (National Institute for Material Research of the CSIR) gave a sensitivity of between −235 and −240 dB re. 1 V/uPa ($1\times10^{-12}$–$1.7\times10^{-12}$V/uPa). This result is 30 dB less than the manufacturers results but can be explained by the pressure reduction due to the matrix material and non-adhesion between the matrix material and the sensor cable. The results of the calibration measurement of the cable are shown in FIG. 12.

Figure 13:
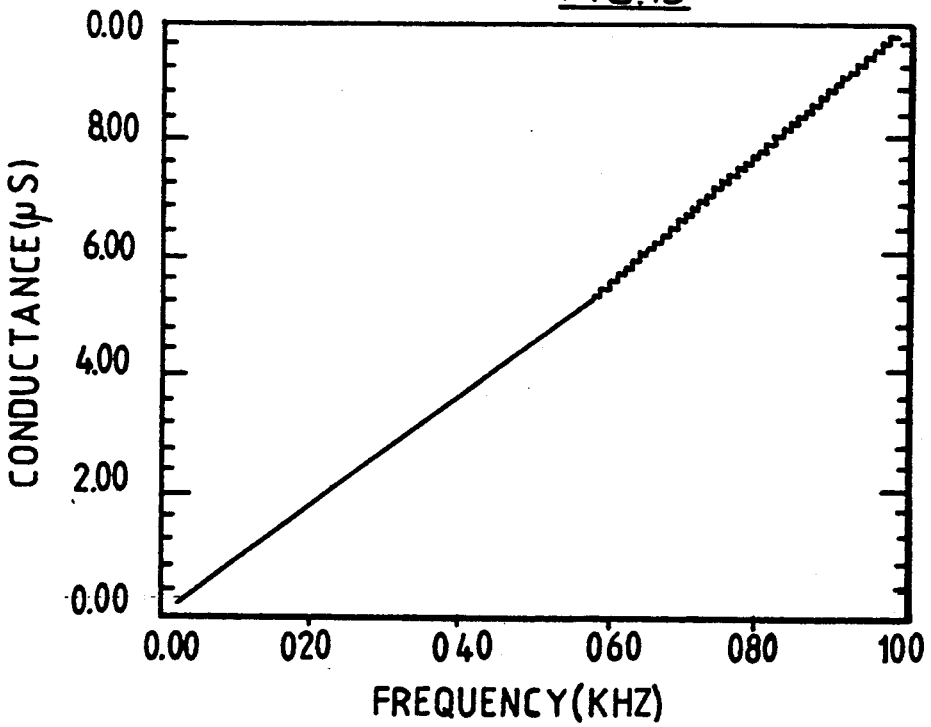
FIG. 13 is a graph of conductance with frequency.

The sensor cable is not expected to have a marked resonance because of its low electromechanical coupling factor. FIG. 13 shows the conductance of the cable sensor as a function of frequency. An absence of peaks indicate that there are no electromechanical resonances in the frequency range 1 to 100 kHz, although a natural resonance in the rubber matrix occurs at approximately 700 Hz, it is not excited because of the low electro-mechanical coupling factor.

The elasticity of the matrix may be conveniently measured by the Shore hardness and this is preferably as constant as possible with temperature variation, preferably around 90°.

Cross sensitivity variation is also reduced by the use of a cable embedded during extrusion of the matrix which has consistent characteristics along its length.

The width of the slot cut into the road surface is an important characteristic in accordance with this invention and is related to the foot print area typical with road vehicles. Preferably the slot width is not less than 5 mm but a practical upper limit is set by durability of the flexible matrix and an advisable upper limit may be set at around 25 mm. For speed measurement the width is also of significance in regard to precision of that measurement.

Preferably the matrix is also selected in regard to its hysteresis. That is the capacity of the matrix material to damp vibrations. By careful selection of the size of slot the elasticity and the hysteresis of the matrix the installation can be made selective in that it can be tuned to optimum receptiveness for the frequency of pulse which is typically received in measurements of vehicle traffic but to attenuate or filter out very high frequency signals such as arise from vibration or other dynamic effects. In this way a more stable and reliable pulse can be generated and fed to the electronic processor.

FIG. *2c* shows an embedment matrix extrusion 21 which allows longitudinally extending hollows 22 and 23 on either side of the embedded cable 4, to reduce noise from cross-over sensitivity.

FIG. *2d* shows a resilient matrix embedment profile 24 surrounded at both sides and bottom by a metal channel 25 which is relatively rigid, e.g. 100 times as rigid as the matrix to shield the cable 4 from noise originating from, e.g. ground vibrations.

Figure 3:
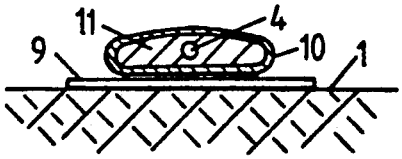
FIG. 3 is a cross sectional elevation of a further preferred embodiment of the invention.

FIG. 3 shows an embodiment of the invention for temporary installation on the top of a road surface 1 comprising a steel base plate 9 which is provided so as to furnish a smooth and consistent surface on to which the device is mounted for cross-wise independance of reading. On to the steel base 9 an abrasive resistant rubber sheathing 10 is provided which is preferably a polymer of shrink type so as to shrink tightly over and enclose a matrix 11 which is again to be an elastic polymer of the characteristics described for the (filler)/matrix 7 in regard to FIG. 1. The coaxial piezo-electric cable 4 which has been described in respect of FIG. 1 is embedded in this matrix. FIG. 4 shows the view of the device seen by approaching vehicles as it is laid cross-wise on a road surface and the high input impedance pre-amplifier 5 and cable 6 are referred to. FIG. *4a* shows a road 18 over which a cable 19 has been laid orthogonally across the road and a cable 20 has been laid diagonally across the road. The residence time of the tire footprint 30 on cable 19 allows the length of the tire footprint to be calculated from vehicle speed (which is obtained, e.g. by twin orthogonal cables a standard distance apart) and the residence time on the diagonal cable allows the width of the tire footing to be calculated since this latter residence time is somewhat longer than the former according to a determinable relationship.

Figure 5:
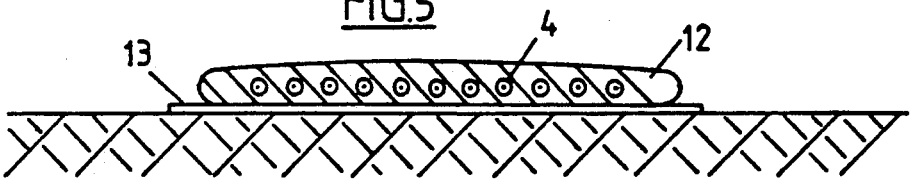
FIG. 5 is a cross sectional elevation of another preferred embodiment of the invention.

FIG. 5 shows how the coaxial cable 4 can be laid in a sinuous or comb-like array again embedded in a flexible polymeric matrix 12 to form a pad. The cable 4 may be in a sinuous arrangement thus endless apart from the start and finish ends and thereby having the lengths of cable continuously connected in series. Alternatively these lengths may be connected in parallel thus analogous to a comb array. These again will be laid on top of a steel plate 13 and optionally a covering plate may be provided on the top surface.

As an alternative approach to the piezo-electric cable, a cable may be selected exhibiting predominant magneto= or electro= strictive effects. For this purpose an oscillator could be used to supply a suitable frequency signal to the cable from which change in the effect can be detected. Although tribo-electric effect is here referred to and is in principle included in the scope of this invention the problem must be overcome of avoiding ringing effects, that is high frequency harmonics associated with the basic pulse and which attenuate over time, by selecting resonant frequency well above operating frequencies. In principle any electrical output from the cable can be used. The flexibility of the cable as such, however, is a cardinal requisite for use in accordance with this invention.

Apart from barium titanate crystals other piezo-electric effect crystals could be used, as referred to in the claims.

Figure 6:
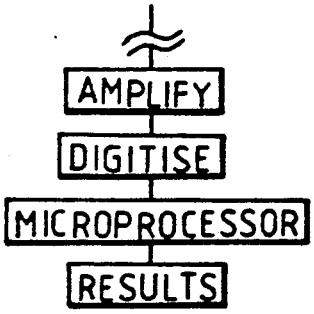
FIG. 6 is a block diagram of electronic circuitry for the invention.

The signal derived from the cable is processed electronically in principle as shown in FIG. 6. Generally speaking amplification is required followed by digitisation at which point the signal is sent to a micro processor for extraction of the information required. The required information is then provided as a result which, of course, can be as a read out, print out, stored in memory or as required.

The micro processor will in general measure various characteristics of the signal or combination of signals, apply compensation as is programmed according to calibration of the cable signal and will then compute results.

An important factor in the design of an acoustic sensor is to gain an idea of the signal threshold due to noise. Three sources of noise are present in the system. These are: ambient acoustic noise, amplifier noise and thermal noise of the amplifier equivalent input impedance.

In the application that the road sensor is to be used, a low frequency response is more important than a high frequency response. It is therefore recommended that an amplifier with a high input impedance is used and that the lead capacitance should be minimised to achieve an acceptable sensitivity. This implies that a high input impedance pre-amplifier should be placed in close proximity to the piezoelectric cable with the intention of reducing thermal noise and increasing sensor sensitivity, this would also maximise the useful low frequency range of the system.

Figure 7:
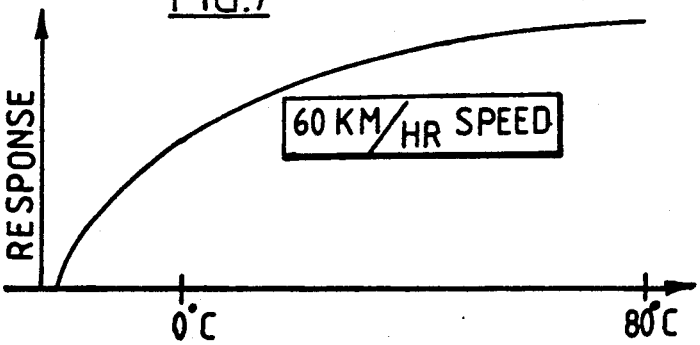
FIG. 7 is a graph showing instrument response against output temperature variation.

FIG. 7 shows typical variations of response of the cable signal both in regard to speed of the vehicle crossing it and in regard to temperature. A cable which is to be employed can be laboratory calibrated prior to use and this calibration can then be stored in the computer or micro processor to apply a compensating correction to the readings given by the cable. For this purpose the equipment could require a temperature sensor. Speed input could be obtained of course by the use of a pair of cables at a standardised distance apart in accordance with conventional speed measurements using coaxial cables. The speed measurement as such is not temperature dependant and once this has been computed it can be applied in accordance with the response function as a correction factor for pressure measurement.

Figure 8:
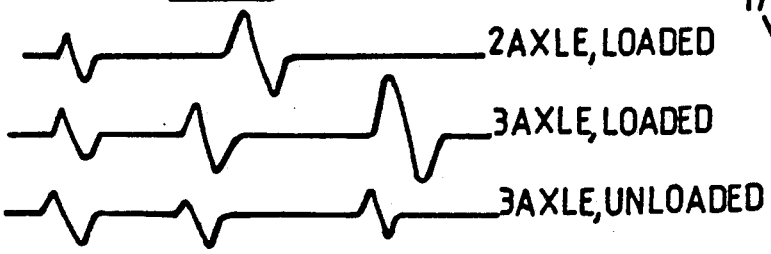
FIG. 8 is a facsimile of instrument responses on test.

FIG. 8 shows typical test results using the installation. It is an advantage of the barium titanate crystal impregnated polyurethane type coaxial cable that reliable pressure measurement can be achieved by a measurement of peak to peak dimension or first peak height. In certain embodiments the alternative approach of integration under the peak has been adopted which in certain conditions has provided a more reliable result with less scatter.

Figure 9:
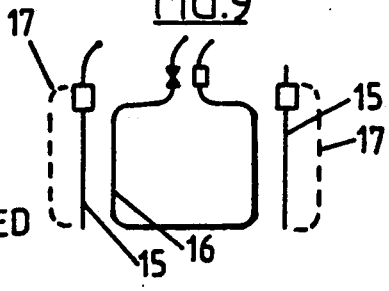
FIG. 9 is a plan view of a further preferred embodiment of the invention.

The twin coax cable layout is preferably used in combination with a vehicle presence detector of any suitable type. One of these types which is the most well known, although there are other types which are available and effective, is the loop. FIG. 9 shows such an array with the two coaxial cables 15 and loop 16. Broken lines 17 show that the loop can be located outside of the limits of the coaxial cable.

As an alternative to the epoxy bitumen lining given to the installation shown in FIG. 1 a metal or polymeric channel section could be set in the road, for example.

In tests it has been found that measurements of speed can be achieved within 1% accuracy. The pressure/-weight signals from the two coax cables can be averaged to increase weight accuracy and in addition speed, vehicle length, gaps or headway, number of axles per vehicle and axle distance are all available from the computer.

It has been found to be an advantage of this installation that it is not necessary to specially calibrate it for each site at which it is installed for speed if it is measured with two cables.

In dealing with the possible different shapes of coax cable this can be extended virtually to the form of a film in which either piezo or the capacitive effects are employed. The essential feature is the embedment of the cable in the elastic medium which provides for the transmission of the signal to the cable and protects it.

To test signal processing schemes, nine parameters describing the measured signal were calculated and evaluated, the parameters were Positive peak Voltage
Negative peak Voltage
Positive Rise time
Negative Rise time
Positive Peak area
Negative Peak area
Total Peak area
Maximim Spectral power (from FFT)
Total Integrated Spectral power These parameters were calculated for the pulse originating from the front axle pulse.

Suitable parameters were selected for predictability and consistency. Some parameters such as positive and negative peak voltages were well correlated with speed for a single wheel on the sensor, this was not the case for two wheels passing over the sensor.

Figure 10:
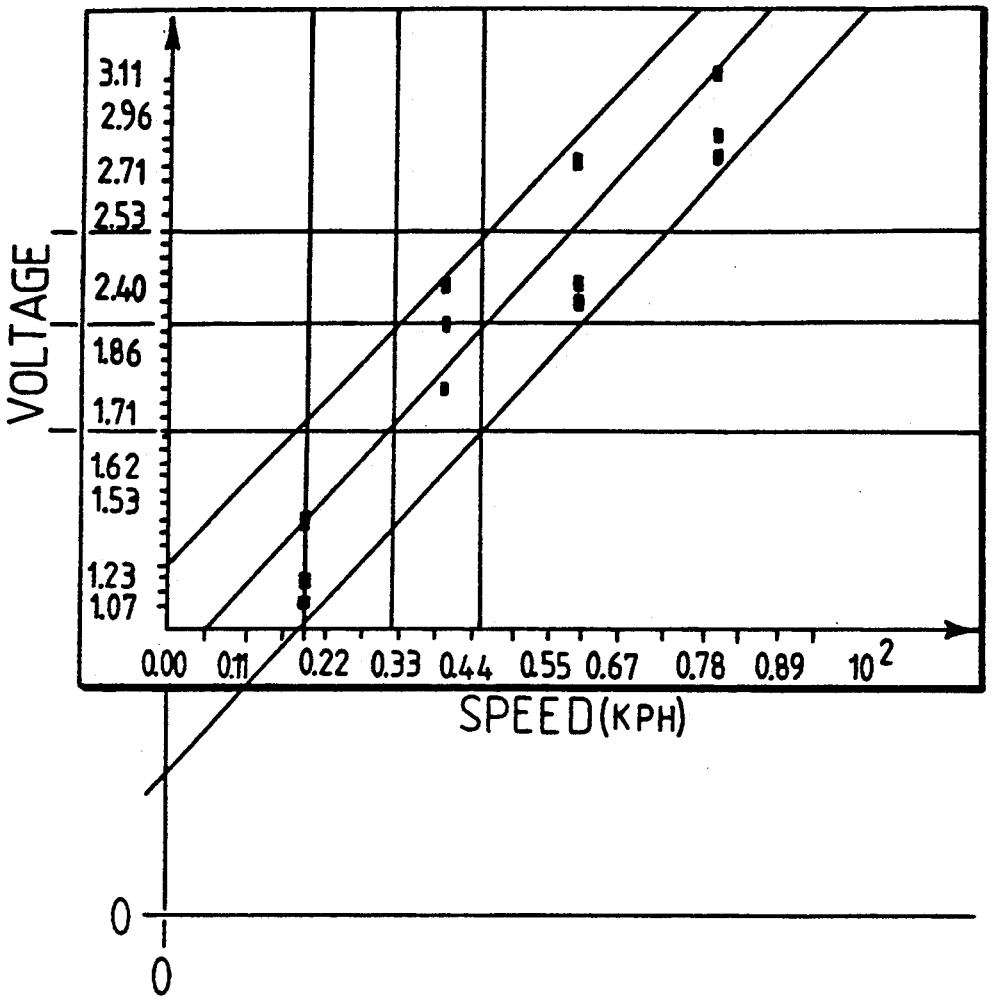
FIG. 10 is a graph of positive peak voltage vs. speed for one wheel.
Figure 11:
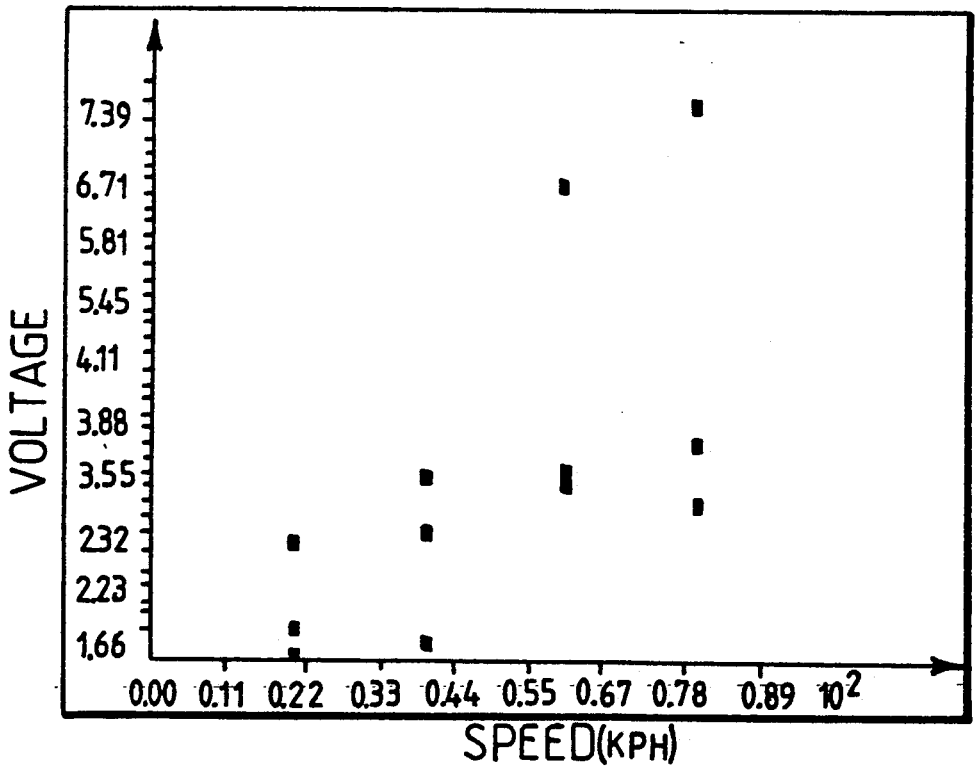
FIG. 11 is a graph of positive peak voltage vs. speed for two wheels.

FIG. 10 shows the variation of positive peak voltage with vehicle speed for the front axle with one wheel passing over the sensor. FIG. 11 shows data for the same parameters for the front axle when both wheels pass over the sensor. It was found that for two wheels passing over the sensor the correlation between the vehicle speed and peak voltage is lower. Table 2 gives values of the correlation between the various parameters and speed for the two cases and both axles.

TABLE 2

| | | Linear Correlation between Voltage output parameters and Vehicle speed | | | |
|---|---|---|---|---|---|
| | | Single Wheel | | Double Wheel | |
| Number | Parameter | Front Axle | Rear Axle | Front Axle | Rear Axle |
| 1 | +ve Peak | 0,94 | 0,90 | 0,63 | 0,50 |
| 2 | −ve Peak | −0,96 | −0,96 | −0,57 | −0,49 |
| 3 | +ve Rise time | −0,94 | −0,93 | −0,90 | −0,89 |
| 4 | −ve Rise time | −0,86 | −0,88 | −0,93 | −0,87 |
| 5 | +ve Peak area | −0,89 | −0,85 | −0,69 | −0,64 |
| 6 | −ve Peak area | 0,92 | 0,90 | 0,77 | 0,77 |
| 7 | Total Peak area | −0,92 | −0,89 | −0,74 | −0,72 |
| 8 | Max Spec Power | −0,04 | 0,09 | −0,55 | −0,47 |
| 9 | Total Spec Power | 0,96 | 0,97 | 0,95 | 0,96 |

Note:
A negative correlation indicates that as the speed increases, the parameter decreases.

Referring to table 2, it can be seen that the correlation coefficients for the single wheel case are all above 0.80 (except for maximum spectral power, parameter 8) whereas for the double wheel case, only parameters 3, 4 and 9 had correlations above 0.8 and many were not correlated at the 95% confidence level. It is important that the parameter used for the final decision of the vehicle mass does not depend on the tire footprint and these results indicate that parameter 9 seems most suitable. Parameters 3 and 4 would only give information on vehicle speed whereas parameter 9 is expected to give good information on vehicle mass as well. The following analysis method is therefore employed in accordance with the invention where the relationship between vehicle mass and total spectral power is known. Parameter 3 and 4 are used to estimate the speed of the vehicle using regression methods and parameter 9 the vehicle mass. (Providing other factors remain constant). (This is for single cable installations). An estimate of speed using conventional two-cable methods would be more accurate, however, and can optionally be used. From the graphs in figures it can be seen that there is a non linear relationship between vehicle speed and total spectral power, this should be taken into account in any computations.

Figure 14:
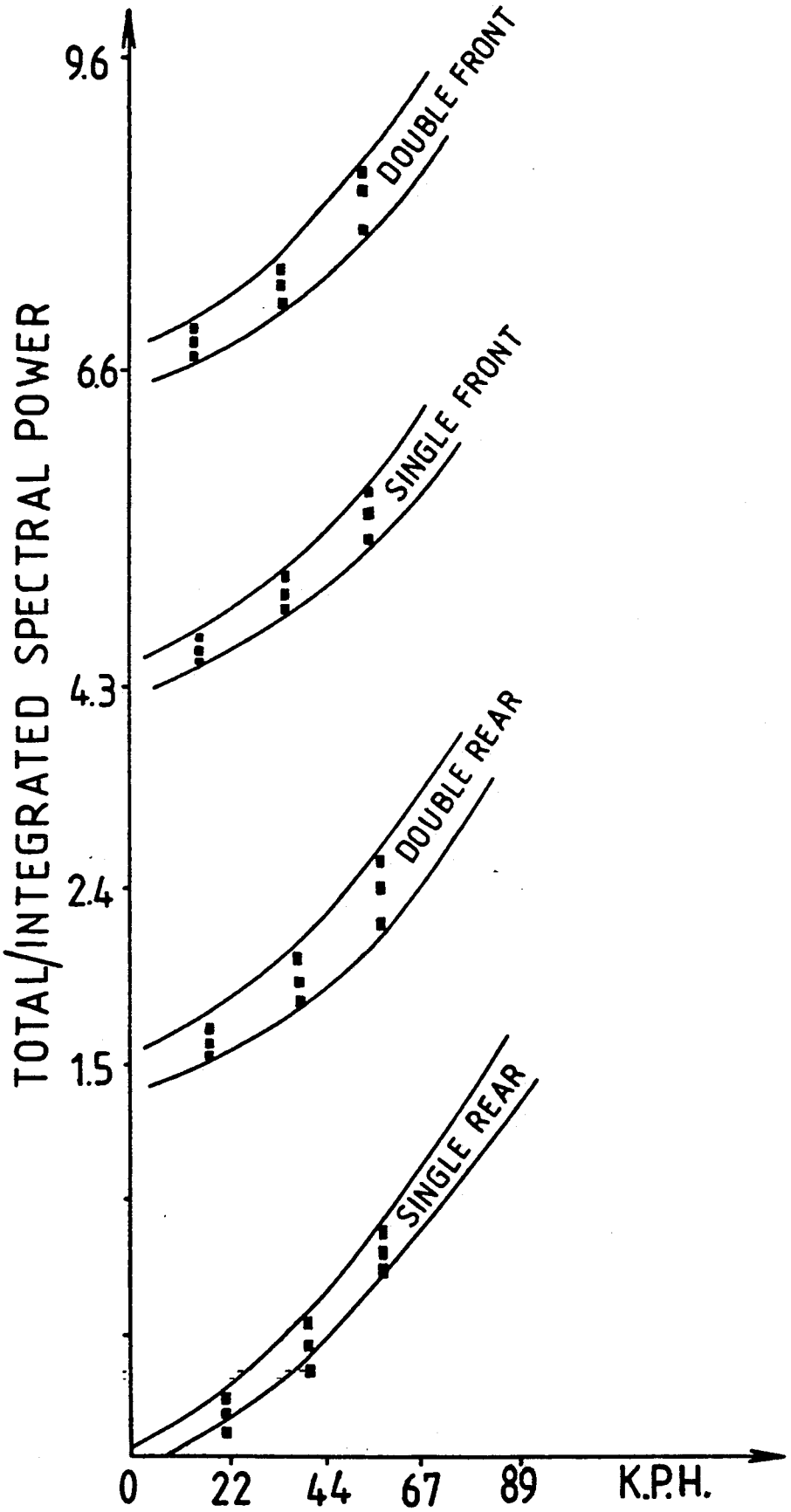
FIG. 14 is a graph of total spectral power vs. speed, weight and tire configuration.

FIGS. 14 shows correlation of total spectral power with speed, weight and tire configuration in typical tests.

It is felt that the linear integration techniques (parameters 5, 6, 7) could provide more accurate data if the matrix material stiffness was increased. The resonant frequency of the sensor system would increase with a stiffer matrix material resulting in the sensor output responding quasistatically to the pressure due to the vehicle. An epoxy or hard polyurethane would be suitable for this application. At present, the excitation of resonant behaviour in the sensor cable diminishes the usefulness of parameters 5, 6 and 7.

In this manner the problems existing in the art of scatter, temperature dependants, speed dependants and cross-wise dependants of reasons have been overcome as well as overcoming "ringing" problems.

We claim:

1. In a traffic data acquisition method comprising laying an electrically conductive cable with at least two conductors separated by a material which has electrical properties selected from one or more of piezo-electric, tribo-electric, magneto=and/or electro=strictive effects, connecting the conductors to an electronic processor comprising an amplifier, digitiser and microprocessor, detecting signals induced in the cable by passage of vehicle wheel(s) over the cable, and processing the signals, the improvements in that the processing of the signals comprises computing a total integrated spectral power of the signals, establishing an empirical relationship between speed and weight of other vehicle wheel(s) passing over the cable and the total spectral power for the cable, inputting the computed total spectral power and one of the speed or weight of the vehicle wheel(s) thereof into the empirical relationship and deriving the other one of the weight or speed of the latter vehicle wheel(s) from the empirical relationship.

2. A method as claimed in claim 1, in which the empirical relationship also takes account of tire configuration and environmental factors including temperature.

3. A method as claimed in claim 1, in which one of the speed or weight of the inputting step is also applied to vehicle classification parameters.

4. Traffic data acquisition method as claimed in claim 1, in which the cable and the matrix are selected to exhibit a pressure sensitivity of the cable in the matrix of at least −200 dB re 1 V/μPa.

5. A method as claimed in claim 1, in which the cable is embedded in a matrix which is laid either on a base plate or in a groove.

6. A method as claimed in claim 5, in which the groove is cut in the road surface, lined with an epoxy bitumen or other suitable lining material, the lining is formed to a groove of consistent cross sectional shape by drawing a forming tool through the material.

7. A method as claimed in claim 1, in which the said cable is laid orthogonally across the road and a second cable is laid diagonally across the road, the residence time of the tire footprint applying pressure to the orthogonal cable is subtracted from the residence time of the tire footprint applying pressure to the diagonal cable, the difference is converted via a measure of speed to a distance difference which is operated on by a tangent function of the angle of the diagonal cable to the orthogonal cable to give a measure of footprint width and length.

8. A method as claimed in claim 1, in which the cable is zig-zagged in a sinuous fashion on a base plate and embedded in a matrix on the base plate.

9. A method as claimed in claim 1, in which the total spectral power is computed by an algorithm employing a regression method.

10. A method as claimed in claim 1, in which total spectral power is derived on the basis of integration of the signals in the frequency domain.

11. In a traffic data acquisition apparatus comprising an electrically conductive flexible cable with at least two conductors separated by a material which has electrical properties selected from one or more of piezo-electric, tribo-electric, magneto=and/or electro=strictive effects, and an electronic processor connected to the conductors, the electronic processor comprising an amplifier, digitiser and micro-processor, the improvement further comprising a matrix embedding the cable the matrix having a natural resonant frequency of more than eight hundred Hertz (800 Hz), and a high input impedance pre-amplifier in the electronic processor connected at least in close proximity to the cable, and the electronic processor applying wheel signals from the cable to pre-processing data algorithms giving information in the form of the total integrated spectral power of the wheel signals.

12. An apparatus as claimed in claim 11, in which the cable is embedded in the matrix in a manner which provides properties of poor acoustic coupling by way of an acoustic discontinuity between the cable and the matrix for high frequencies above one kilohertz (1 kHz).

13. Traffic data acquisition apparatus as claimed in claim 12, in which the piezo-electric crystals are a barium titanate of polyvinylidenefluorinate and the matrix is a two-part silicone rubber intended for use as a moulding rubber.

14. An apparatus as claimed in claim 11, in which the poisson's ratio of the material of the matrix is close to 0.5.

15. An apparatus as claimed in claim 11, in which the proportions of the matrix are that its depth is at least twice its width.

16. Traffic data acquisition apparatus as claimed in claim 11, in which the predominating piezo-electric properties are provided by granulated crystals in a polymeric material, the crystals being selected from one or more piezo electric ceramics and ceramic composites, polymers and copolymers.

17. An apparatus as claimed in claim 11, in which the cable is embedded in the matrix in a manner which favors transmission from the matrix to the cable of normal pressures and only poorly transmits or decouples shear stresses.

18. An apparatus as claimed in claim 17, in which two longitudinally extended hollows run contiguous with the cable on either side of the cable.

19. An apparatus as claimed in claim 17, in which the cable is closely surrounded on all sides except the top and optionally the bottom by a longitudinally extending relatively rigid channel having a modulus of elasticity at least one hundred times as high as that of the matrix.

* * * * *